United States Patent [19]

Zbornik

[11] Patent Number: 4,962,654

[45] Date of Patent: Oct. 16, 1990

[54] METHOD OF BENDING SHEET METAL PIECES TO A PREDETERMINED BENDING ANGLE

[75] Inventor: Vaclav Zbornik, Oftringen, Switzerland

[73] Assignee: Haemmerle AG, Switzerland

[21] Appl. No.: 346,139

[22] Filed: May 2, 1989

[30] Foreign Application Priority Data

May 3, 1988 [AT] Austria ..... 1140/88

[51] Int. Cl.[5] ..... B21D 5/02

[52] U.S. Cl. ..... 72/8; 72/10; 72/19; 72/21; 72/389; 72/448; 72/473

[58] Field of Search ..... 72/389, 448, 386, 431, 72/432, 465, 453.03, 702, 473, 21, 19, 8, 10

[56] References Cited

U.S. PATENT DOCUMENTS

| | | | |
|---|---|---|---|
| 3,552,182 | 1/1971 | Handler | 72/432 |
| 3,978,706 | 9/1976 | Nakagawa et al. | 72/389 |
| 4,106,323 | 8/1978 | Haenni et al. | 72/448 |
| 4,131,008 | 12/1978 | Malatto | 72/389 |
| 4,552,002 | 11/1985 | Haenni et al. | 72/19 |
| 4,653,307 | 3/1987 | Zbornik | 72/389 |
| 4,802,357 | 2/1989 | Jones | 72/702 |
| 4,819,467 | 4/1989 | Graf et al. | 72/702 |

*Primary Examiner*—David Jones

*Attorney, Agent, or Firm*—Tarolli, Sundheim & Covell

[57] ABSTRACT

A method of bending sheet metal pieces by means of a bending apparatus having a bending bar and a bottom die with adjustable die bottom. In a first step, the practical bending behavior of a sample sheet metal piece having a certain thickness and a certain material quality is determined and stored as a reference curve trace. In a second step, when bending further sheet metal pieces with the same thickness and having equal material quality, the effective bending behavior of each sheet metal piece is determined and compared with the stored reference curve trace. Then, the position of the adjustable die bottom is corrected on the basis of the calculated difference.

6 Claims, 2 Drawing Sheets

METHOD OF BENDING SHEET METAL PIECES TO A PREDETERMINED BENDING ANGLE

BACKGROUND OF THE INVENTION

1. Field of the Invention

The present invention refers to a method of bending sheet metal pieces to a predetermined bending angle by means of a bending apparatus having a computer control means and comprising a movable bending bar and a fixed bottom die having a die bottom member, the height position thereof being adjustable in accordance with the bending angle to be achieved.

It is known in the art that the bending angle of a sheet metal piece which is processed in a bending apparatus having a movable bending bar and a cooperating bending die can be theoretically approximately defined by the penetration depth of the bending bar into the bottom die, the latter one having a well defined die aperture width. However, practice has shown that the effective bending angle exhibits smaller or larger deviations from the above mentioned theoretical bending angle due to tolerances of the thickness and the material quality of the sheet metal piece to be bent.

2. Prior Art

A certain improvement has been made possible by the use of a bending apparatus in which the bending angle can be adjusted and changed easily and exactly. Preferably, such an apparatus comprises a bottom die having an upper longitudinal aperture directed towards the bending bar and a die bottom member which can be adjusted in height position. The bending angle is exactly defined by the height position of the die bottom member, and by re-adjusting said position different bending angles can be realized without the need of exchanging the bottom die.

The bottom die comprises a longitudinally running groove whose opening is directed towards the bending bar, and the bending angle is defined by the distance between the two fixed upper edges of the groove running parallel to each other and by the height position of the top surface of the movable die bottom member. However, if the bending operation is performed with a plurality of sheet metal pieces having equal thicknesses and substantially equal material qualities, it was observed that deviations of the resulting bending angle occur nevertheless. On the one hand, these deviations are caused by the fact that never the theoretical sharp edge develops in the sheet metal piece as is present at the bending bar but the bent edge is more or less rounded which greatly influences the final bending angle. On the other hand, a resilient spring back movement of the two legs of the bent sheet metal workpiece can be observed as soon as the bending force is released from the workpiece with the result that the actual bending angle does not coincide with the theoretically calculated value of the bending angle. The spring back rate also depends on the thickness of the sheet metal piece and the material quality thereof.

In practice, this means that two sheet metal pieces having equal nominal thickness and substantially equal material quality but originating from different manufacturers or from different production batches never show exactly the same bending angle after having been bent with the same bending apparatus and the same bottom die set-up because the behaviour of the sheet metal piece materials can be slightly different as far as the resulting rounding of the bent edge and as the spring back rate is concerned.

In order to improve the accuracy of a bending operation, a plate bending apparatus is disclosed in U.S. Pat. No. 4,552,002 which utilizes a bending punch and a bottom die into which the bending punch penetrates to a greater or lesser extent depending on the desired bending angle. Thereby, the magnitude and variation of the bending force required during the bending operation of the sheet metal plate is measured and utilized to determine the depth of punch penetration. This apparatus yields quite good results.

OBJECTS OF THE INVENTION

It is an object of the invention to improve the methods known in the prior art and to provide a method of bending metal workpieces to a predetermined bending angle within very narrow tolerances.

It is a further object of the invention to provide a method of bending sheet metal workpieces to a predetermined bending angle within very narrow tolerances independently of their material quality and/or thickness.

SUMMARY OF THE INVENTION

According to the invention, there is provided a method of bending a workpiece to a predetermined bending angle by means of a bending apparatus having a computer control means and comprising a movable bending bar and a fixed bottom die. The bottom die has a die bottom member, the height position thereof being adjustable in accordance with the bending angle to be achieved.

In a first step, a sample sheet metal piece having a predetermined thickness and a predetermined material quality is inserted between the movable bending bar and the bottom die, and the sample sheet metal piece is stepwise bent to different bending angles. Thereby, the depth of penetration of the bending bar into the bottom die is noted for each bending angle so that a series of bending angle/penetration depth value pairs is obtained.

From said value pairs a curve trace is derived and stored in the computer control means as a reference curve trace representing the bending behaviour of this particular sample sheet metal piece. Finally, the sample sheet metal piece is removed from the bending apparatus.

The next step includes the real production of bent sheet metal pieces. For this purpose, production sheet metal pieces are successively inserted between the bending bar and the bottom die having a thickness tolerance and a material quality substantially equal to the sample sheet metal piece. Then, the adjustable die bottom is adjusted to a first height position corresponding to the predetermined final bending angle according to the stored reference curve trace and the bending of the production sheet metal piece is started.

Thereby, the bending behaviour of each production sheet metal piece is determined and its bending behaviour is compared with the bending behaviour of the sample sheet metal piece stored in the computer control means. If a deviation is observed, the aforementioned first height position of the adjustable die bottom is corrected in function of the deviation observed between the stored bending behaviour and the bending behaviour of the production sheet metal piece under process. Finally, the bending operation is continued until the leading edge of the production sheet metal piece touches the top surface of said adjustable die bottom.

It is understood that these production steps are repeated as long as sheet metal pieces having equal nominal thickness and substantially equal material quality are processed. If bent sheet metal pieces have to be produced from blanks with different thickness and/or different material quality, the first step has to be run again to obtain a reference curve trace representative for that kind of sheet metal. In practice, it is not necessary to always run the first step first; since all reference curve traces are stored in the computer control means of the bending apparatus, the individual curve trace representative for the bending behaviour of a certain sheet-metal material can be recalled if this certain sheet metal has to be bent.

BRIEF DESCRIPTION OF THE DRAWINGS

In the following, the method of the invention will be further described in detail with reference to the accompanying drawings, in which FIGS. 1–3 each show a diagrammatic sectional view of the relevant parts of a bending apparatus.

DETAILED DESCRIPTION OF A PREFERRED EMBODIMENT

In performing the method of the invention, a bending apparatus is used which is known per se in the art and which comprises a movable bending bar and a fixed bottom die having an adjustable die bottom. The bending bar penetrates the bottom die to a greater or smaller extend in function of the bending angle to be achieved. The theoretically achieved bending angle is predetermined by the height position of the adjustable die bottom as long as the width of the bottom die aperture remains constant.

Figure 1:
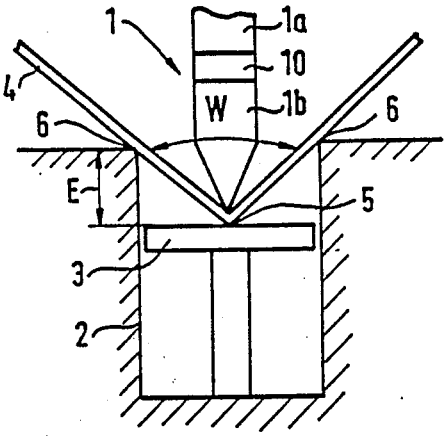

The bending apparatus schematically shown in FIG. 1 comprises a bending bar 1 which is fixed to the movable ram of the bending apparatus in any suitable manner and driven to a reciprocating vertical movement. The bending bar 1 cooperates with a fixed bottom die 2 mounted on the worktable of the bending apparatus. The bottom die 2 has an adjustable die bottom 3, the height position thereof determining the maximum penetration of the bending bar 1 into the aperture of the bottom die 2 and thereby the resulting bending angle W.

In operation, a sheet metal piece 4 is inserted between the bending bar 1 and the bottom die 2, and the bending bar 1 is driven towards the bottom die 2. A bending edge of the bending bar 1 deforms the sheet metal piece 4 which is supported by the two parallel running upper terminal edges 6 of the aperture in the bottom die 2. The bending operation is stopped as soon as the leading edge 5 of the bent sheet metal piece 4 touches the top surface of the adjustable die bottom 3. The bending angle W is determined by the position of said leading edge 5 with reference to the two terminal edges 6. In FIG. 1, the depth of penetration of the leading edge 5 of the sheet metal piece 4 is designated by E.

Figure 2:
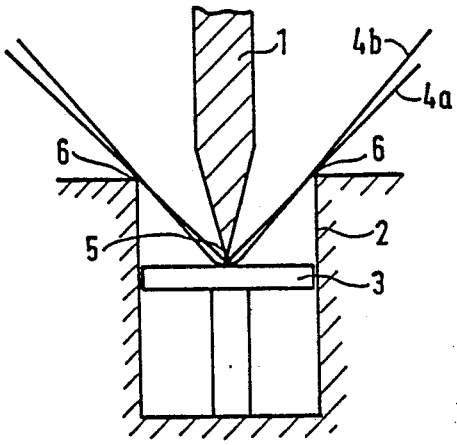

As already mentioned, the bending angle W depends on the radius of curvature of the bending edge of the sheet metal piece 4. FIG. 2 schematically shows how the bending angle W changes with the radius of curvature of the bending edge. The sheet metal piece 4*a* comprises (theoretically) a very sharp edge in the form of a straight line while the sheet metal piece 4*b* has a rounded bending edge. It can clearly be seen that the angle enclosed by the two legs of the sheet metal piece 4*a* is somewhat greater than the angle enclosed by the two legs of the sheet metal piece 4*b*. In general, it can be stated: The greater the radius of curvature of the bending edge of the sheet metal piece is, the smaller is the resulting bending angle, the set-up of the bottom die 2 remaining unchanged.

Figure 3:
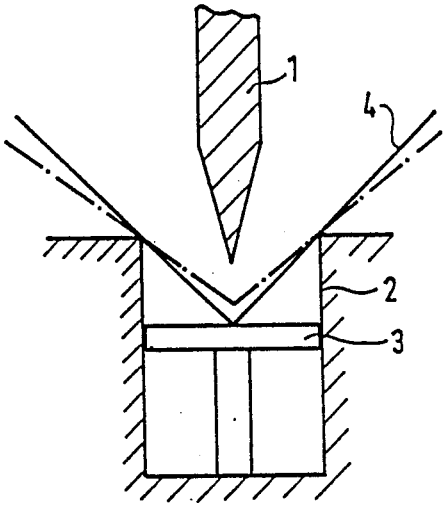

In FIG. 3 there is shown, in a heavily exaggerated view, the material spring back behaviour of a bent sheet metal piece 4. It can be clearly seen that the sheet metal piece exhibits a spring back of its two legs once the bending force exerted by the bending bar 1 is released. The sheet metal piece 4 being relaxed (the bending bar 1 being retracted), the two legs thereof enclosing a bending angle which is somewhat greater than the theoretical bending angle in the situation when the bending bar 1 presses the sheet metal piece 4 completely towards the top surface of the adjustable die bottom 3. The spring back rate is dependent on the thickness and on the material quality of the sheet metal and cannot be calculated in advance with the required accuracy.

Figure 4:
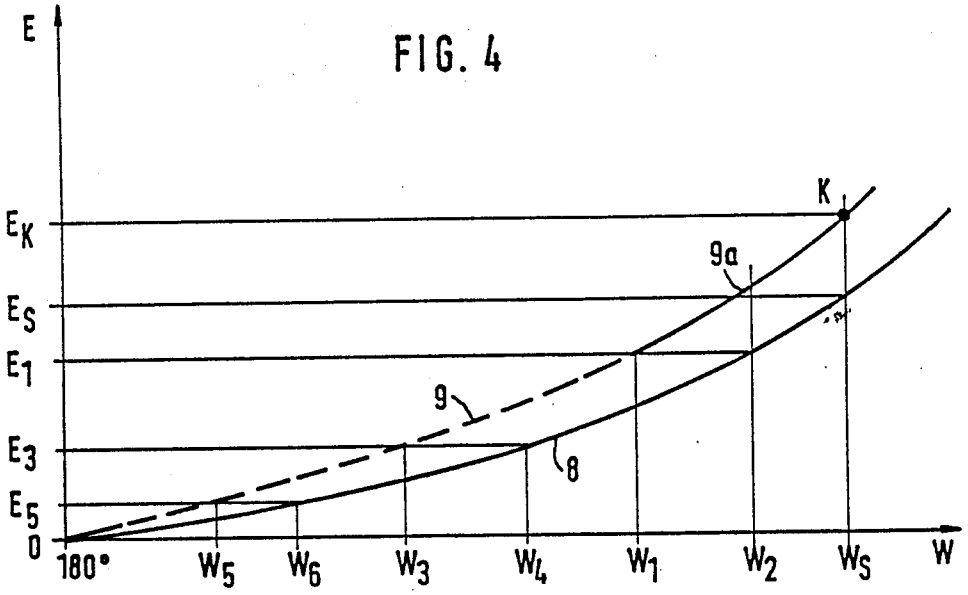
FIG. 4 shows a diagram representing the course of the bending angle in function of the penetration depth of the bending bar.

The real course of bending of a sample sheet metal piece is shown in FIG. 4 by a curve trace 8 indicating the bending angle W of the sample sheet metal piece in function of the penetration depth E of the bending bar 1 into the bottom die 2. The shape of the curve trace 8 is influenced not only by the thickness of the sheet metal piece to be bent but also the tensile yield strength, the modulus of elasticity and the hardness increase characteristics of the material of the sheet metal piece.

According to the method of the invention, in a first step, the real bending behaviour of the sheet metal material is determined by bending a sample sheet metal piece having a certain thickness and a certain known material quality in a test run. Thereby, a plurality of pairs of measured values W and E are obtained and a bending curve trace 8 is developed on the basis of these measured values. This curve trace 8 is stored as reference curve trace representative for sheet metal pieces having the above mentioned certain thickness and material quality.

Now, in a second step, the real production of bent sheet metal piece begins; it is understood that a sheet metal is used which is essentially equal to the sheet metal of which the test sample consists. However, experience has shown that slight variations in thickness and/or quality can occur so that the bending operation has to be corrected to get the desired final bending angle.

Initially, the position of the adjustable die bottom 3 and thereby the penetration depth of the bending bar 1 into the bottom die 2 is adjusted to such a value $E_s$ which corresponds to the finally desired bending angle $W_s$ according to the reference curve trace 8. Now, the bending operation is run. When the bending bar 1 has reached a first penetration depth $E_5$, the real bending angle of the production sheet metal piece is measured and a value of $W_5$ is obtained. The real bending angle $W_5$ is compared with the bending angle $W_6$ obtained with the help of the reference curve trace 8 and corresponding to the same penetration depth $E_5$. The calculated difference $W_5-W_6$ shows that the real bending angle $W_5$ is greater than the theoretically expected bending angle $W_6$.

In a corresponding manner, the real bending angle $W_3$ is measured at the penetration depth $E_3$ and the real bending angle $W_1$ is measured at the penetration depth $E_1$, and both angles $W_3$ and $W_1$ are compared with the corresponding angles $W_4$ and $W_2$, respectively, obtained from the stored reference curve trace 8.

With this particular sheet metal piece now being processed, a somewhat different curve trace 9 of the bending behaviour is obtained; the curve trace 9 is shown in FIG. 4 in broken lines. This curve trace 9 makes clear that the real bending angle is greater than the theoretically expected bending angle at the same depth of penetration of the bending bar 1 into the bottom die 2.

Due to the observed difference the adjustable die bottom 3 of the bottom die 2 must be set to a corrected position. The finally desired bending angle $W_s$ will not be reached at the theoretically determined penetration depth $E_s$ but only at the corrected penetration depth $E_k$.

On the basis of the observed angle differences $W_5-W_6$, $W_3-W_4$ and $W_1-W_2$ the corrected penetration depth $E_k$, i.e. the corrected position of the adjustable die bottom 3, can be readily determined and set. Figuratively speaking, this can be effected for instance by supplementing the curve trace 9 by a portion of the stored reference curve trace 8. In fact, a portion of the curve trace 8 from the angle $W_2$ to well over the angle $W_s$ is added to the curve trace 9 at the end thereof corresponding to the angle $W_1$; this added portion is shown in FIG. 4 in heavier lines and designated by reference numeral 9*a*. Drawing a straight line running parallel to the Y-axis (E-axis) through the point on the X-axis (W-axis) of FIG. 4 corresponding to the finally desired bending angle $W_s$ yields an intersection point K with the curve trace portion 9*a*, and drawing a straight line running parallel to the X-axis (W-axis) through intersection point K yields the value $E_k$ for the corrected depth of penetration of the bending bar 1 into the bottom die 2 and, thereby, the corrected position of the adjustable die bottom 3. Consequently, the adjustable die bottom 3 is set to the corrected value $E_k$ and the bending operation continued. At the end of the bending operation, when the leading edge of the bent sheet metal piece 4 touches the top surface of the adjustable die bottom 3 set to the corrected position $E_k$, the bending angle of the sheet metal piece 4 will have the exact value of $W_s$.

In practice, the extrapolation process of the bending behaviour curve trace 9 on the basis of the known reference curve trace 8 explained hereinabove is effected in a computer supported control means used to control the bending apparatus and in which also the reference curve trace 8 is stored. This extrapolation is permissible without sacrificing an essential part of accuracy as, in practice, the effective deviation of the curve trace 9 from the curve trace 8 is very small; in the drawing of FIG. 4, this deviation is exaggeratedly shown for the reason of clarity. The theoretically resulting inaccuracy by extrapolating the curve trace 9 with a portion of the stored reference curve trace 8 is that small that it can be neglected without hesitation.

In practically performing the method of the invention it is advantageous to measure the bending angles in each case when the bending force exerted by the bending bar 1 is acting on the sheet metal piece; i.e. the bending angles both of the sample sheet metal pieces during determining the reference curve trace 8 and of the real production sheet metal pieces upon measuring the bending angles W in relation to the depth of penetration E of the bending bar 1 into the bottom die 2.

Furthermore, it is advantageous to effect the last check measurement of the bending angle well before the finally expected bending angle is reached such that sufficient time is left to effect the correction of the position of the adjustable die bottom member 3. On the other hand, the last check measurement of the bending angle should be performed as late as possible so that only a comparatively short portion of the curve trace 9 has to be extrapolated on the basis of the reference curve trace 8 with the result that the accuracy of the finally reached bending angle further increases.

A further possibility of performing the method of the invention can consist in considering, besides the effective course of bending, also the magnitude and the course of the force required to bend a sheet metal piece. Thereby, a sample sheet metal piece having a certain thickness and a certain material quality is bent to a plurality of bending angles and the force required to bend the sheet metal piece is determined. Thus, a plurality of value pairs is obtained, representing the required bending force in relation to the depth of penetration or to the resulting bending angle, a curve trace is derived from these value pairs and stored as a reference curve trace belonging to the above mentioned thickness and material quality of the sheet metal.

Figure 5:
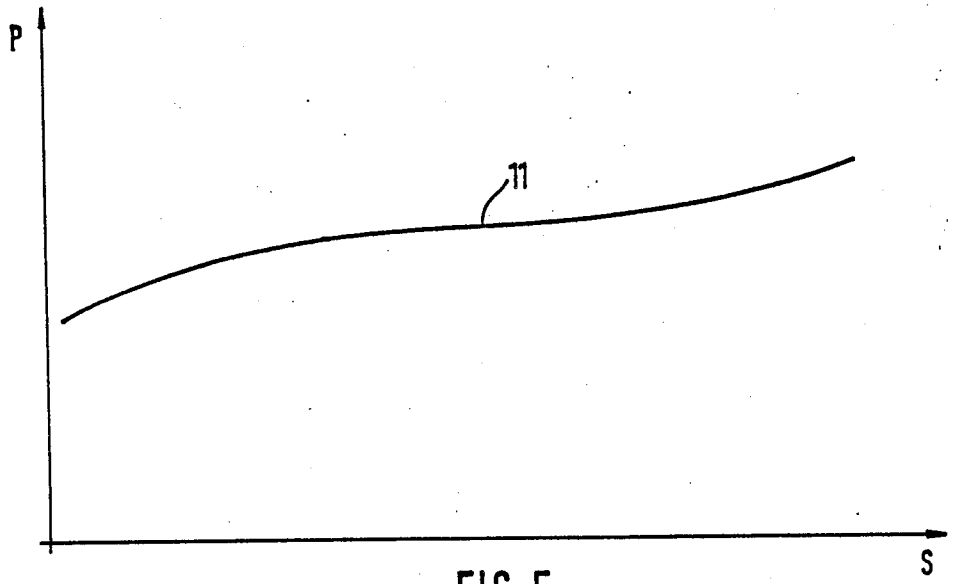
FIG. 5 shows a diagram representing the course of the bending force in function of the path of displacement of the bending bar.

Experience has shown that the resulting bending angles are not constant with different substantially equal sheet metal pieces even at a constant penetration depth of the bending bar 1 into the bottom die 2 and unchanged set-up of the bottom die 2. In contrast, the bending angle varies due to slight tolerances in sheet metal thickness and material quality since one piece of sheet metal requires more bending force than another substantially equal piece of sheet metal. Thus, a relation exists between the bending angle and the penetration depth which depends on the individual course of the magnitude of the bending force. The method of the invention can be improved by additionally measuring the magnitude of the instant bending force during the path of movement of the bending bar 1 and feeding the measured value to a computer in which the reference curve trace is stored. A curve trace 11 as shown in FIG. 5 is obtained showing the effective course of the magnitude P of the bending force in function of the path of movement s of the bending bar 1. This effective course of the bending force is compared with the stored reference curve trace whereby the determined differences are used to additionally correct the depth of penetration of the bending bar 1 into the bottom die 2, i.e. in fact to correct the position of the adjustable die bottom 3.

According to a practical embodiment as shown schematically in FIG. 1, the bending bar 1 consists of an upper portion 1*a* and a lower portion 1*b*. Between the two portions 1*a* and 1*b* a measuring means 10 is inserted. The measuring means may comprise, for instance, an electric pressure gauge and serves to measure the force P exerted by the bending bar 1 to the sheet metal piece 4 to be bent. The measured values are processed in a computer which influences the control means for the adjustment of the die bottom 3.

The novel method is particularly suitable to bend thin sheets or lattens and constitutes a substantial advance in the art of metal plate bending since sheet metal pieces will now be capable of being processed automatically with great precision and without having to make allowances for individual differences in physical properties of the sheet metal pieces.

What I claim is:

1. A method of bending a workpiece to a predetermined bending angle by means of a bending apparatus having a computer control means and comprising a movable bending bar and a fixed bottom die having a die bottom member, the height position thereof being adjustable in accordance with the bending angle to be achieved, the method comprising the steps of:

inserting a sample sheet metal piece having a predetermined thickness and a predetermined material quality between said movable bending bar and said bottom die;

bending said sample sheet metal piece to different bending angles and noting the depth of penetration of said bending bar into said bottom die for each bending angle, thereby obtaining a series of bending angle/penetration depth value pairs;

deriving from said value pairs a curve trace and storing it in said computer control means as a reference curve trace representing the bending behaviour of said sample sheet metal piece;

removing said sample sheet metal piece from the bending apparatus; and successively inserting production sheet metal pieces having a thickness tolerance and a material quality substantially equal to said sample sheet metal piece between said bending bar and said bottom die, adjusting said adjustable die bottom to a first height position corresponding to said predetermined bending angle according to said stored reference curve trace and starting to bend each production sheet metal piece, determining the bending behaviour of each production sheet metal piece and comparing its bending behaviour with the bending behaviour of said sample sheet metal piece stored in said computer control means, correcting said first height position of said adjustable die bottom as a function of a deviation observed between said stored bending behaviour and the bending behaviour of said production sheet metal piece under process, and continuing the bending operation until the leading edge of said production sheet metal piece touches the top surface of said adjustable die bottom.

2. A method according to claim 1 in which said step of determining the bending behaviour of each production sheet metal piece comprises the steps of measuring the effective bending angle of said production sheet metal piece for different depths of penetration of said movable bending bar.

3. A method according to claims 1 or 2 in which said step of comparing the bending behaviour of said production sheet metal piece with the bending behaviour of said sample sheet metal piece stored in said computer control means comprises the step of determining the difference between said bending angles according to said stored reference curve trace and said effective bending angle.

4. A method according to claim 1 in which said step of correcting said first height position of said adjustable die bottom as a function of a deviation observed between said stored bending behaviour and the bending behaviour of said production sheet metal piece under process comprises the steps of extrapolating the bonding behaviour of said production sheet metal piece determined during a first portion of the bending operation, on the basis of said stored bending behaviour of said sample sheet metal piece and determining a correction value for the height position of said adjustable die bottom from said extrapolated bending behaviour of said production sheet metal piece.

5. A method according to claim 4 in which said effective bending angles of said production sheet metal piece obtained during said first portion of the bending operation is measured under load of the bending force acting on said production sheet metal piece.

6. A method of bending a workpiece to a predetermined bending angle by means of a bending apparatus having a computer control means and comprising a movable bending bar and a fixed bottom die having a die bottom member, the height position thereof being adjustable in accordance with the bending angle to be achieved, the method comprising the steps of:

inserting a sample sheet metal piece having a predetermined thickness and a predetermined material quality between said movable bending bar and said bottom die;

bending said sample sheet metal piece to different bending angles;

noting the depth of penetration of said bending bar into said bottom die for each bending angle, thereby obtaining a first series of bending angle/-penetration depth value pairs;

deriving from said first value pairs a curve trace and storing it in said computer control means as a first reference curve trace representing the bending behaviour of said sample sheet metal piece;

noting the bending force exerted by said bending bar on said sample sheet metal piece which is required to move the bending bar to a penetration depth corresponding to each bending angle, thereby obtaining a second series of bending force/penetration depth value pairs;

deriving from said second value pairs a curve trace and storing it in said computer control means as a second reference curve trace representing the bending behaviour of said sample sheet metal piece;

removing said sample sheet metal piece from the bending apparatus; and successively inserting production sheet metal pieces having a thickness tolerance and a material quality substantially equal to said sample sheet metal piece between said bending bar and said bottom die, adjusting said adjustable die bottom to a first height position corresponding to said predetermined bending angle according to said first reference curve trace and starting to bend each production sheet metal piece, determining the bending behaviour of each production sheet metal piece and comparing its bending behaviour with the bending behaviour of said sample sheet metal piece represented by said first and said second curve traces stored in said computer control means, correcting said first height position of said adjustable die bottom as a function of a deviation observed between said stored bending behaviour represented by said first and second curve traces and the bending behaviour of said production sheet metal piece under process, and continuing the bending operation until the leading edge of said production sheet metal piece touches the top surface of said adjustable die bottom.

* * * * *